United States Patent [19]

Friebel

[11] 4,265,145

[45] May 5, 1981

[54] RING-PISTON METER WITH A PLANETARY-GEAR DIFFERENTIAL

[75] Inventor: Eberhard Friebel, Berlin, Fed. Rep. of Germany

[73] Assignee: Siemens Aktiengesellschaft, Berlin & Munich, Fed. Rep. of Germany

[21] Appl. No.: 42,849

[22] Filed: May 29, 1979

Related U.S. Application Data

[63] Continuation of Ser. No. 795,494, May 10, 1977, abandoned.

[30] Foreign Application Priority Data

May 28, 1976 [DE] Fed. Rep. of Germany ... 7617502[U]

[51] Int. Cl.[3] ..... F16H 1/28; G01F 3/08

[52] U.S. Cl. ..... 74/805; 73/253; 73/255

[58] Field of Search ..... 74/805; 73/253, 254, 73/255

[56] References Cited

U.S. PATENT DOCUMENTS

| | | | |
|---|---|---|---|
| 2,250,259 | 7/1941 | Foote, Jr. | 74/805 |
| 2,281,490 | 4/1942 | Granberg et al. | 73/260 |
| 3,965,774 | 6/1976 | Omi et al. | 74/805 |
| 4,007,635 | 2/1977 | Friebel | 73/273 |
| 4,027,541 | 6/1977 | Nishioka | 74/805 X |
| 4,063,710 | 12/1977 | Minami et al. | 74/805 |

FOREIGN PATENT DOCUMENTS

| | | | |
|---|---|---|---|
| 713163 | 11/1941 | Fed. Rep. of Germany | 73/255 |
| 865661 | 2/1953 | Fed. Rep. of Germany | 73/253 |
| 865662 | 2/1953 | Fed. Rep. of Germany | 73/253 |
| 2431751 | 1/1976 | Fed. Rep. of Germany | 73/253 |

*Primary Examiner*—Leslie Braun

*Attorney, Agent, or Firm*—Kenyon and Kenyon

[57] ABSTRACT

A ring-piston meter comprising a planetary-gear differential adapted to be responsive to a driving pin arranged eccentrically to the axis of a ring piston. The planetary-gear differential comprises a stationary ring gear and a further gear adapted to be connected to an output shaft and having a number of teeth different from that of the ring gear. The planetary-gear differential further includes a planetary gear which is arranged to mesh with the ring gear and the further gear and which is supported on a driving disk. The latter disk, in turn, is supported rotatably and coaxially with the output shaft and includes a slot adapted to be engaged with the driving pin.

1 Claim, 1 Drawing Figure

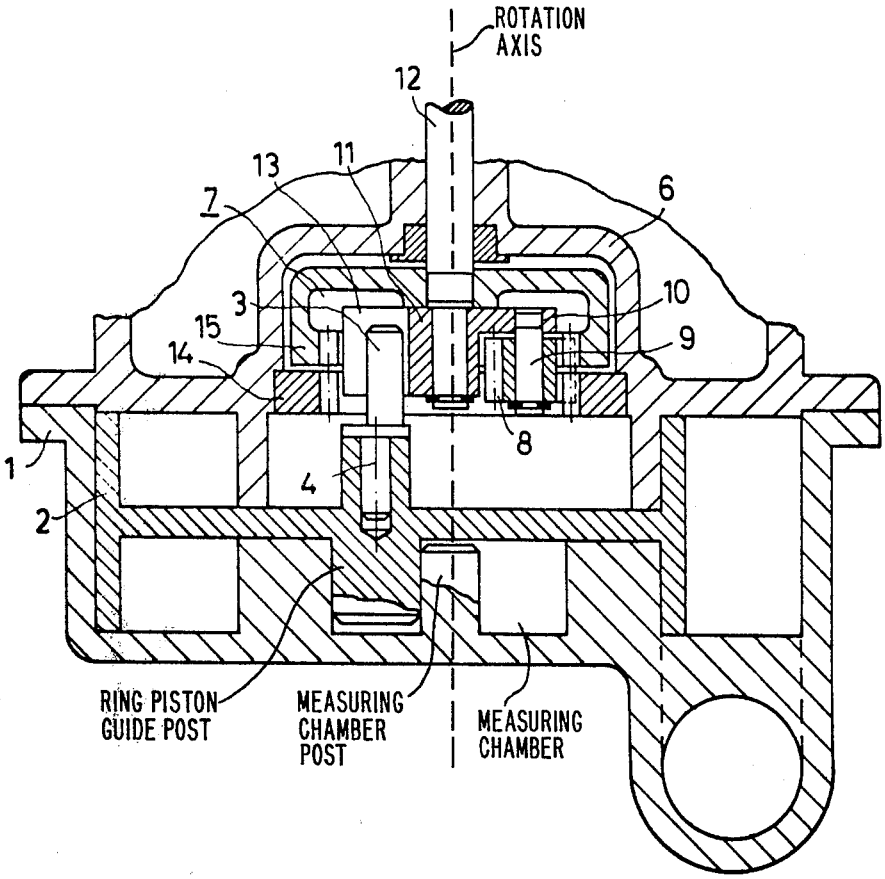
ROTATION AXIS
12
13
11
7
6
3
10
15
9
14
8
1
4
2
RING PISTON GUIDE POST
MEASURING CHAMBER POST
MEASURING CHAMBER

RING-PISTON METER WITH A PLANETARY-GEAR DIFFERENTIAL

This is a continuation of application Ser. No. 795,494, filed May 10, 1979, now abandoned.

BACKGROUND OF THE INVENTION

1. Field of the Invention

The invention relates to a ring-piston meter comprising a planetary-gear differential adapted to be responsive to a driving pin or a ring piston and including a planetary gear arranged to mesh with a stationary ring gear and a further gear connected to an output shaft and having a number of teeth different from that of the ring gear.

2. Description of the Prior Art

In a ring-piston meter of the above type the planetary gear is fastened to the driving pin of the ring piston, the latter pin being held centrally at the ring piston. As a consequence of the aforesaid construction of the meter, the nonuniform rotary motion of the ring piston prevents the meter from exhibiting a high degree of measuring accuracy. In addition, the measurement values obtained when measuring small quantitites are not suited for further processing in control devices and the like.

It is, therefore, an object of the present invention to provide a ring-piston meter comprising a planetary-gear differential wherein compensation for the nonuniform rotary motion of the ring-piston is provided.

SUMMARY OF THE INVENTION

In accordance with the principles of the present invention, the above and other objectives are accomplished in a ring-piston meter of the above described type by further including therein a driving disk which is rotatably supported coaxially to the output shaft and which has a slot for engaging the driving pin which is arranged eccentrically to the central axis of the ring-piston.

An advantage of the ring-piston meter of the present invention is that by employing a driving disk and an eccentric arrangement of the driving pin relative to the central axis of the ring piston, the nonuniform rotary motion of the ring-piston is compensated for. As a result, the output shaft of the planetary-gear differential rotates uniformly, if the flow through the ring-piston meter is constant. Small quantitites of liquid can thus be measured with great accuracy and, if desired, the measurement values so obtained can be further processed successfully in control devices.

BRIEF DESCRIPTION OF THE DRAWING

The above and other features and aspects of the present invention will become more apparent upon reading the following detailed description in conjunction with the accompanying drawing in which the sole FIGURE illustrates a ring-piston meter in accordance with the principles of the present invention.

DETAILED DESCRIPTION

As shown, the ring-piston meter of the invention comprises a housing 1 in which a ring-piston 2 is supported rotatably in a conventional manner. The ring-piston 2 carries a driving pin 3 which is arranged eccentrically to the central axis 4 of the ring-piston.

Supported on the ring-piston housing 1 is a housing 6 of a planetary-gear differential 7. The planetary-gear differential 7 comprises a planetary-gear 8 which is rotatably supported on a shaft 9. The shaft 9 is held in a hold 10 of a driving disk 11. The driving disk 11, which is rotatably mounted on an output shaft 12 of the planetary-gear differential 7, has on its side diametrically opposite the bearing of the planetary-gear 8, a slot 13 which receives the driving pin 3 of the ring piston 2.

The planetary-gear differential 7 further comprises a ring gear 14, which is fixedly held in the housing 6 and which is arranged so that its teeth mesh with the planetary-gear 8. The gear differential 7 is also provided with a further gear 15 which is fastened on the output shaft 12 and also meshes with the planetary gear 8. The gear 15 has a number of teeth different from that of the stationary ring gear, e.g., one or two teeth less, so that the output shaft 12 is driven by the ring piston 2 with a large step-down ratio.

The nonuniform rotary motion of the ring piston is compensated for in the aforesaid arrangement of the invention due to the driving pin 3, which as above-noted, is arranged eccentrically to the central axis 4 of the ring piston 2, and, thus, drives the driving disk 11, upon rotation of the ring piston 2, with a continuously varying radius. Through a suitable eccentric arrangement of the driving pin 3, the aforesaid driving compensates for the angular velocity of the ring piston 2, which is principle in nonuniform, in such a manner that a largely uniform rotary motion is imparted to the output shaft 12. This permits small quantities of liquid to be measured with great measuring accuracy using the present arrangement.

What is claimed is:

1. A ring piston meter comprising a ring piston and a planetary gear-differential coupling said ring piston to an output shaft, said ring piston having a driving pin arranged eccentrically with respect to the central axis thereof and being adapted to move about the axis of said output shaft, said planetary-gear differential including:

a stationary ring gear;

a further gear adapted to be connected to said output shaft, said further gear having a number of teeth which differs from the number of teeth of said ring gear;

a planetary gear arranged to mesh with said ring gear and said further gear;

and a driving disk for supporting said planetary gear, said driving disk being rotatably supported coaxially with the axis of said output shaft and having a slot adapted to be engaged by said driving pin.

* * * * *